US007453351B2

(12) United States Patent
Fitzgibbon et al.

(10) Patent No.: US 7,453,351 B2
(45) Date of Patent: Nov. 18, 2008

(54) DELAY-BASED ACCESS CONTROL APPARATUS AND METHOD

(75) Inventors: James J. Fitzgibbon, Batavia, IL (US); Walter Parsadayan, Lake Forest, CA (US)

(73) Assignee: The Chamberlain Group, Inc., Elmhurst, IL (US)

( * ) Notice: Subject to any disclaimer, the term of this patent is extended or adjusted under 35 U.S.C. 154(b) by 152 days.

(21) Appl. No.: 10/963,438

(22) Filed: Oct. 12, 2004

(65) Prior Publication Data

US 2006/0082337 A1 Apr. 20, 2006

(51) Int. Cl.
*G08B 23/00* (2006.01)

(52) U.S. Cl. ..... 340/527; 340/528; 340/545.1; 340/545.3; 340/556; 340/541; 340/5.7; 340/5.71

(58) Field of Classification Search ..... 340/527, 340/528, 545.1, 545.3, 556, 541, 5.7, 5.71
See application file for complete search history.

(56) References Cited

U.S. PATENT DOCUMENTS 4,429,264 A * 1/1984 Richmond ..... 318/466
6,326,754 B1 12/2001 Mullet et al.
6,388,573 B1 * 5/2002 Smith et al. ..... 340/556
6,437,527 B1 * 8/2002 Rhodes et al. ..... 318/280
7,242,295 B1 * 7/2007 Milinusic et al. ..... 340/541

* cited by examiner

*Primary Examiner*—Tai T Nguyen
(74) *Attorney, Agent, or Firm*—Fitch, Even, Tabin & Flannery

(57) ABSTRACT

An access control mechanism such as a movable barrier operator (70) has a first time window unit (72) that is responsive to one or more triggers (71) (such as a delayed-closure button). An event detector (73) then monitors for one or more events of interest during a corresponding first time window. For example, the event detector can monitor for evidence that a vehicle is moving towards a garage exit or has effected an exit from the garage. A second time window unit (74) responsive at least to the event detector and optionally as well to the first time window unit then responds with a second time window. Upon conclusion of the second time window, a movable barrier closer (75) initiates movement of the corresponding movable barrier towards a closed position (or other position of interest).

16 Claims, 3 Drawing Sheets

DELAY-BASED ACCESS CONTROL APPARATUS AND METHOD

TECHNICAL FIELD

This invention relates generally to access control apparatus and methodology and more particularly to the controlled automated movement of a corresponding barrier.

BACKGROUND

Automated access control apparatus and methods are known in the art and include both remote user control as well as more autonomous control functionality and capability. Movable barrier operators (such as, but not limited to, garage door openers, pivoting and sliding gate operators, pivoting guard arm operators, rolling shutter operators, and so forth), for example, are a nearly ubiquitous example of such access control mechanisms.

Increased automation and functional autonomy represents a desired design goal. Many users, for example, generally wish for barriers in their path to open and close in a timely and convenient manner with little or no effort or even conscious regard on their part. Security and environmental concerns, of course, often blunt such design aspirations. Cost, too, frequently figures as a sobering counterpoint to fielding such capabilities. Nevertheless, as a general principle, increased automation remains an important and viable design requirement in many instances.

One simple prior art example in this regard comprises a garage door opener that offers a delayed closure button in addition to a more traditional immediate closure button. When asserted by a user, the delayed closure button initiates a non-adjustable 30 second timer. At the conclusion of that period of time, the corresponding garage door will automatically close. This presumes that the provided window time will be sufficient to permit, for example, a pedestrian or vehicle located within the garage to withdraw from the garage prior to the garage door closing in this manner. Should this prove untrue in a given instance, contact between the closing garage door and an obstacle such as a vehicle caught in the path of the closing barrier is sensed in a usual fashion and movement of the barrier is stopped and/or reversed.

There are numerous problems with such an approach. For example, the pre-set period of time may be insufficient in many instances. As a result, the garage door may close prior to the person (or persons) or vehicle having removed themselves from the garage. This, in turn, can force the user to issue another instruction to cause the door to open (presuming that the garage door has not, in fact, made contact with a vehicle or exiting person while closing and reversed its motion). The pre-set period of time could be modified to provide a longer period of time, but this raises other issues. For example, a five minute delay may provide a window of opportunity that will likely accommodate a timely exit by vehicles or persons, but also may present an unacceptable window of vulnerability to unauthorized entry by others.

BRIEF DESCRIPTION OF THE DRAWINGS

The above needs are at least partially met through provision of the delay-based access control apparatus and method described in the following detailed description, particularly when studied in conjunction with the drawings, wherein.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

Generally speaking, pursuant to these various embodiments, in response to detecting a predetermined event (such as, but not limited to, assertion of a user interface such as a delayed closure button, attainment of an opened position by a given movable barrier, and so forth), an access control mechanism automatically determines whether a second predetermined event occurs. Upon occurrence of this second predetermined event, a time delay is automatically initiated and, upon conclusion of the time delay, closure of a corresponding barrier is automatically initiated. When the second predetermined event does not occur, however, automatic closure of the barrier does not occur.

The second predetermined event (i.e., the event that triggers initiation of the aforementioned time delay) may comprise an incident such as detecting movement of an object, such as a vehicle. Such movement may, for example, be indicative of an exiting movement of the vehicle from the garage. Pursuant to some approaches, such movement can be detected through detection of a particular pattern (or patterns) of apparent object movement.

Also pursuant to some approaches, a second (possibly different) time duration can be employed to provide temporal bounds to detection of the second predetermined event. For example, if the second predetermined event does not occur within this second duration of time, the monitoring process may conclude and the barrier will be retained, at least for the moment, in an opened position.

Figure 1:
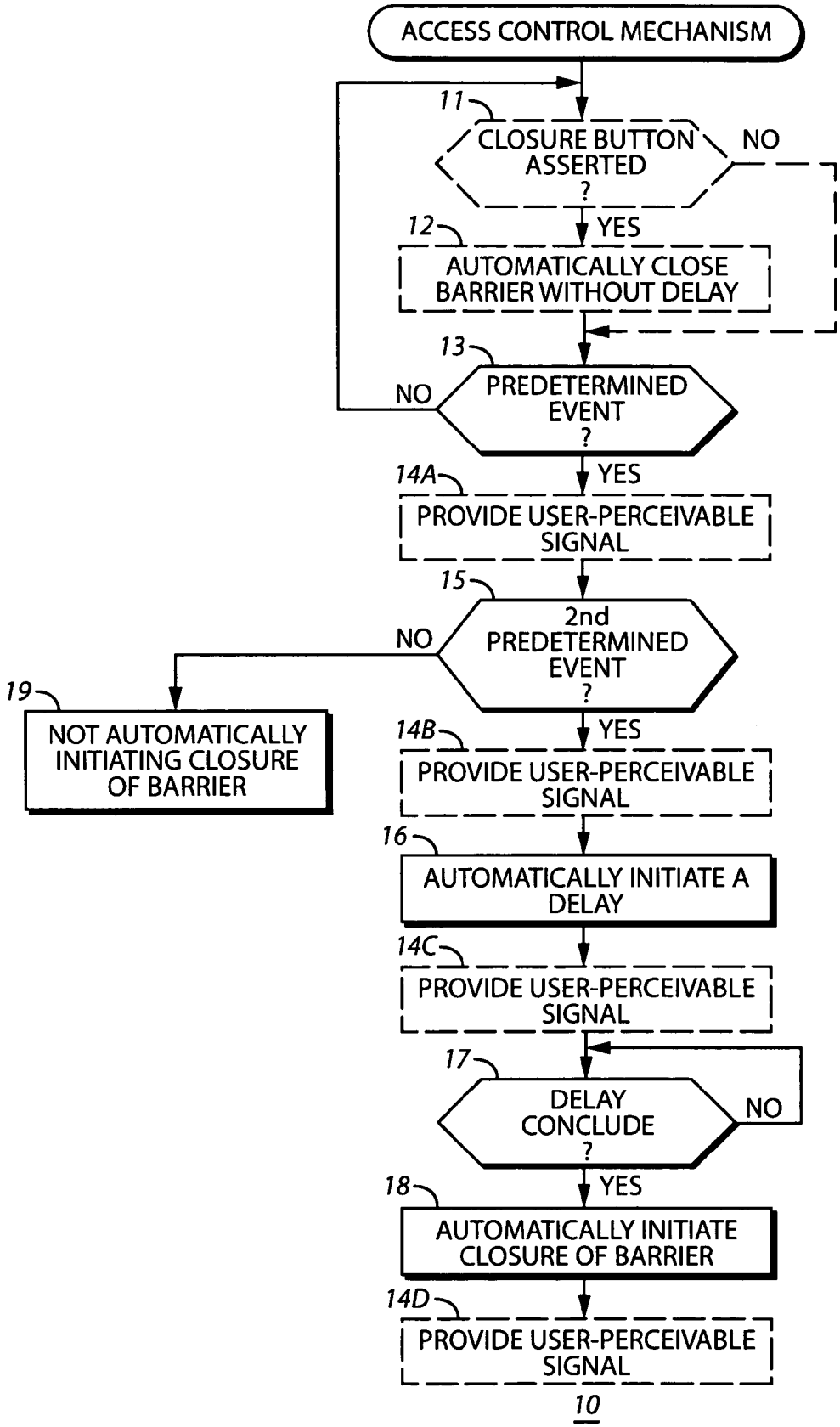
FIG. 1 comprises a flow diagram as configured in accordance with various embodiments of the invention.

These and other benefits may become more evident upon making a thorough review and study of the following detailed description. Referring now to the drawings, and in particular to FIG. 1, a process 10 for use by an access control mechanism will be described.

At the outset, and as noted above, these teachings serve, in part, to facilitate a delayed closing of a movable barrier. Those skilled in the art will understand and recognize that these teachings may be compatibly deployed in conjunction with other practices as well, including numerous present practices.

For example, these teachings will readily support optional detection 11 of assertion by a user of a closure button (such as a closure button as may be provided on a wireless or wired remote user interface). These teachings will further support, in response to detection of such an assertion, automatic initiation 12 of closure of a corresponding movable barrier without any such delay. In a typical such embodiment, the above-mentioned closure button will be discrete and separate from a delayed closure button, but a more integrated approach may be employed if desired.

This process 10 generally provides for detection 13 of a predetermined event (or, in some cases, a plurality of predetermined events that may, or may not, differ from one another). This predetermined event can vary widely with the specifics of a given application. For example, pursuant to some approaches, the predetermined event can comprise assertion of a user interface such as, but not limited to, a delayed closure button (as already noted above, such a delayed closure button will preferably, but not necessarily, comprise a discrete entity as compared to an ordinary (or immediate) closure button).

As another example, pursuant to some approaches, the predetermined event can comprise detecting some predetermined event as regards the movable barrier itself. As one illustration, the predetermined event can comprise detecting the opening of a given movable barrier and/or attainment by the movable barrier of a substantially fully-opened position. Other predetermined events are also possible and again may be selected for use in a manner that best suits the needs and requirements of a given context.

If desired, this process 10 will optionally support provision 14A of a user-perceivable signal in response to detecting such a predetermined event. Such a user-perceivable signal can comprise any of a variety of visual, auditory, or other kinds of annunciation and signaling devices and approaches. For example, when the access control mechanism comprises a garage door opener, and when the garage door opener has the native ability to control overhead lighting for the garage, some or all of that overhead lighting may be caused to dim, flash, or exhibit some other discernable visual signal. As another example, one or more light emitting diodes can be caused to illuminate. As yet another example, an alphanumeric and/or corresponding graphic message or indicator can be provided on a display to serve as a user-perceivable signal. In a similar manner, one or more auditory signals can be provided to serve this same purpose. Such auditory signals can comprise a distinctive tone or tone pattern, a pre-recorded or synthesized voice message, and so forth. Again, the selection of a particular user-perceivable signal and/or the use of a user-perceivable signal can and will vary with the specifics of a given installation.

Pursuant to this process 10, upon detecting this predetermined event, one then monitors for the occurrence of a second predetermined event. Upon detecting 15, or failing to detect, this second predetermined event, the process 10 then automatically effects various specific responses. In many cases, this second predetermined event will usefully comprise detection of at least one indicia as corresponds to movement of an object. The object of interest can comprise, for example, a vehicle (such as but not limited to an automobile, a bicycle, a motorcycle, and the like) and/or a living object (such as a person, pet, or the like).

The movement of interest can vary, again, with the specifics of a given application. In many instances, however, the movement of interest will correspond to movement of a vehicle or a person from within a garage to the exterior of the garage. Such movement may be adequately detected in at least some cases through use of an individual sensor coupled with a strategy requiring detection of only a single indication of movement. In other cases, however, such an approach may provide ambiguous results. Such an approach may indeed detect movement, but may fail to adequately assess the extent and/or nature of the movement. For example, a vehicle within the garage may make some movement towards the garage exit, but may stop short of fully exiting the garage. As another example, a second vehicle may actually enter the garage during the period of detection, and this inwardly-directed movement may be inappropriately interpreted as comprising outwardly-directed movement of a first car that is already within the garage.

Figure 3:
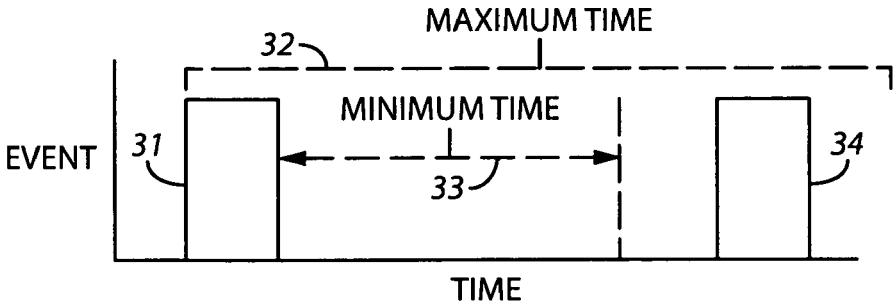
FIG. 3 comprises a graph as configured in accordance with various embodiments of the invention.

To aid in ameliorating such possibilities, the second predetermined event may comprise, for example, the detection of a pattern of indicia as corresponds to movement of the object. As one example, and referring momentarily to FIG. 3, a sensor (or sensors) may be positioned to detect when the tires of an automobile are present or absent. So configured, two signal pulses 31 and 34, wherein each signal pulse corresponds to the sensing of a set of tires as the vehicle moves past the sensor(s), may be required to constitute a single second predetermined event for these purposes. This, in turn, will readily support determining whether a specific detected pattern corresponds to one or more specific modes of object movement.

For example, to aid in ensuring that a vehicle is not only likely moving, but moving with sufficient speed to ensure the timely exiting of the vehicle from the garage, it may be required that the two signal events 31 and 34 occur within a maximum allotted period of time 32. Otherwise, one may conclude that the vehicle is moving too slowly to ensure its having fully exited the garage. It may also be useful in at least some applications to further assess such multiple signal events 31 and 34 with respect to a minimum intervening period of time 33. For example, it may be required that the trailing signal event not occur too soon with respect to the detection of the leading signal event, as such a pattern may well indicate conditions other than normal movement of a single vehicle in an expected direction.

Figure 4:
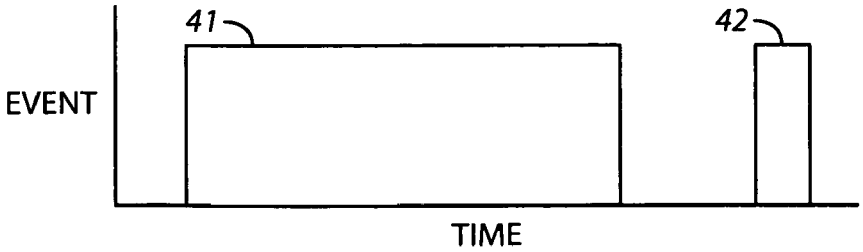
FIG. 4 comprises a graph as configured in accordance with various embodiments of the invention.

Numerous other possibilities with respect to useful pattern detection exist. In many cases, as a general principle, it may be useful to assess whether a detected pattern of activity comprises a series of sensed events as illustrated above. It may also be helpful in some settings to assess whether at least one such sensed event exhibits at least a predetermined duration. For example, and referring momentarily to FIG. 4, a given condition of interest and/or a given sensor deployment may provide pulses 41 and 42 of varying length when detecting the corresponding event of interest. In such a case, determination of pulse duration will comprise a useful metric to aid in properly detecting, analyzing, assessing, and interpreting the detection results. If desired, an access control mechanism learning process (either user initiated or automatically facilitated) can be used to aid in developing such specifics regarding a particular object or condition of interest.

Figure 2:
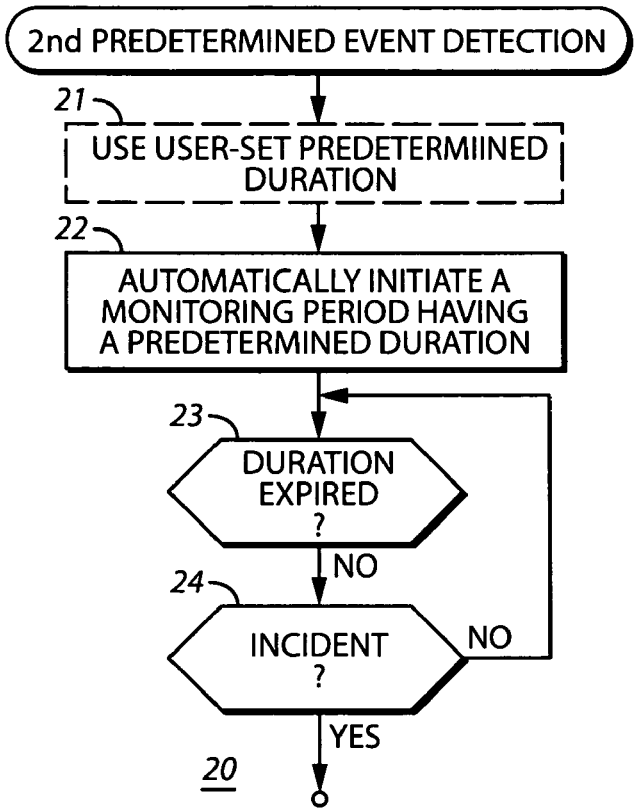
FIG. 2 comprises a flow diagram as configured in accordance with various embodiments of the invention.

Perhaps for most applications it will be useful to bound such monitoring for a second predetermined event within some specific duration of time. For example, and referring momentarily to FIG. 2, using either a user-set predetermined duration 21 (as might be set, for example, via an appropriate user interface) and/or an otherwise predetermined duration value (such as, for example, 30 seconds, 60 seconds, 90 seconds, or the like), a corresponding process 20 can automatically initiate 22 a monitoring period having at least this predetermined duration. Such a monitoring period can be established in various ways, including through use of a timer, a decrementing or incrementing count, and so forth as will be well understood by those skilled in the art.

This process 20 then monitors 23 for expiration of the predetermined duration and, until such expiration occurs, also monitors 24 to detect whether the predetermined event (or events) of interest occur during that predetermined duration of time.

Referring again to FIG. 1, upon detecting 15 the second predetermined event this process 10 can optionally provide a corresponding user-perceivable signal. As before, this optional indication can comprise essentially any kind of user-perceivable signal and may, or may not, differ, in part or in whole, from other user-perceivable signals as may be proffered via this process 10 or by the corresponding access control mechanism.

This process 10 then provides for the automatic initiation 16 of a period of delay (and again, such an action can instigate a corresponding optional user-perceivable signal 14C if desired). This delay can be of set and invariable duration if desired, but will more preferably comprise a modifiable parameter, at least within some reasonable range of settings. For example, the access control mechanism can provide a user accessible potentiometer or other control surface or interface to permit a user to select or modify this period of delay. As another example, when automated learning processes are employed (for example, to learn a characteristic pattern as corresponds to movement of a given vehicle from within the garage), the learning process may also comprise automated or user-informed setting or adjustment of such a delay value. In general, though preferably adjustable, there will nevertheless preferably be at least a required minimum period of delay to prevent a user or automated circumstance from effectively reducing this period of delay to zero.

Upon determining 17 that this period of delay has concluded, this process 10 then automatically causes the access control mechanism to initiate closure 18 of the corresponding barrier (and, once again, if desired, this action can be accompanied by a corresponding user-perceivable signal 14D). If desired, the closure of the movable barrier is accompanied by one or more obstacle detection protocols as are known and well understood in the art. Via this precaution, movement of the barrier can be halted and/or reversed, or other actions taken, upon sensing the presence of an obstacle in the path of the movable barrier. As such procedures are well understood in the art, no further elaboration is provided here for the sake of brevity and the preservation of focus.

Figure 5:
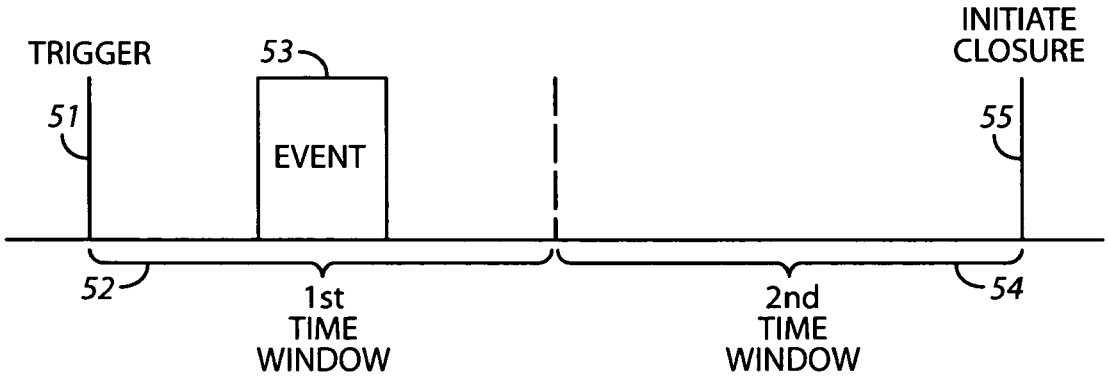
FIG. 5 comprises a graph as configured in accordance with various embodiments of the invention.

The teachings set forth above are compatible with a variety of implementation strategies. As one illustration, and referring now to FIG. 5, a first trigger event 51 (such as assertion of a delayed-closure button by a user) initiates a first time window 52, during which one monitors for a predetermined event 53 that evidences, in this illustrative example, movement of an object such as a vehicle. In this example, upon sensing the event 53 of interest and upon the conclusion of the first time window 52, one then initiates a second time window 54. Finally, upon expiration of the second time window 54, one then initiates closure 55 of the corresponding movable barrier.

So configured, automated delayed closure is itself dependent upon and a function of detecting some indicator regarding a condition of interest, such as movement of a person or vehicle towards an exit. As described above, the event 53 of interest may comprise a single sensed event, a series of sensed events, one or more sensed events having at least a predetermined duration, and so forth as appropriate to the needs and specifics of a given application and setting.

Figure 6:
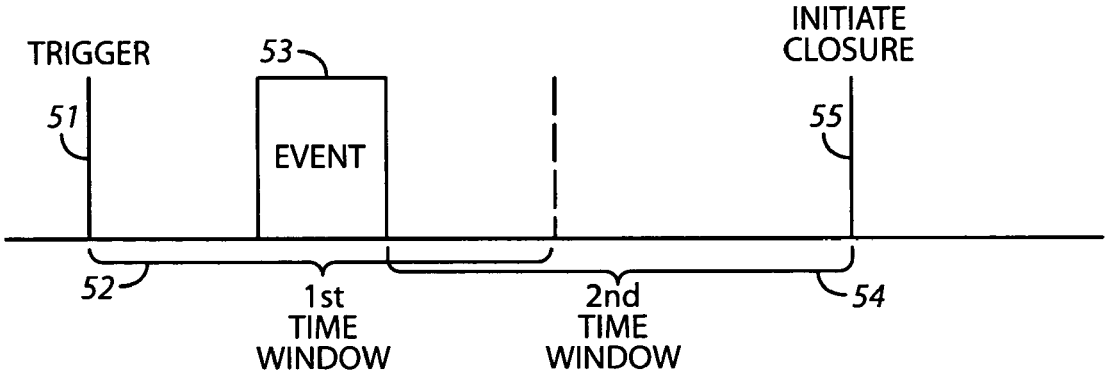
FIG. 6 comprises a graph as configured in accordance with various embodiments of the invention.

As another illustrative example, and referring now to FIG. 6, instead of waiting for conclusion of the first time window 52, if desired, the second time window 54 can be initiated immediately (or within or following some predetermined additional period of delay) upon sensing and/or confirming the event 53 of interest. This approach will likely result, at least under some operating circumstances, in an earlier relative closure of the movable barrier itself.

Figure 7:
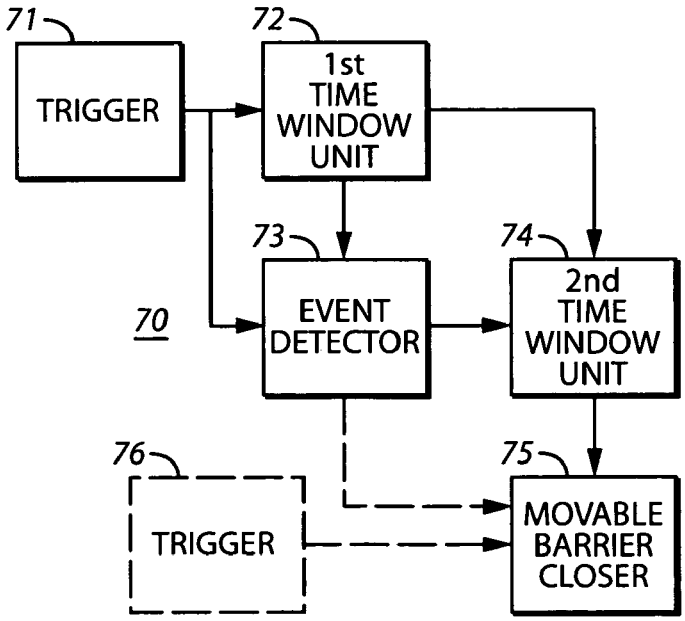
FIG. 7 comprises a block diagram as configured in accordance with various embodiments of the invention.

Those skilled in the art will recognize and understand that these teachings can be deployed in various ways and through various means. As a non-exhaustive illustration, and referring now to FIG. 7, a movable barrier operator 70 can be comprised, in part, of a trigger 71 (for example, a user-assertable interface such as a button and/or a movable barrier position detector that responds to disposition of the movable barrier at an opened position) and a first time window unit 72 (such as a timer) that is responsive thereto. As described above, the first time window unit 72 provides a first time window having a substantially predetermined duration (which duration may be dynamically truncated, if desired, in response to detected events, changing conditions, or the like).

This illustrative movable barrier operator 70 further comprises an event detector 73 that is responsive to the trigger 71 and the first time window unit 73. This event detector 73 serves in general to detect at least one indicia that corresponds to movement of an object. This can comprise detecting a single indicator and/or detecting a pattern of indicia as corresponds to movement of the object. Pursuant to some approaches, this can further comprise the ability to detect any of a plurality of different patterns or other indicia to thereby permit discrete detection of a corresponding plurality of different objects and/or differing modes of movement (such as varying speeds of movement and/or directions of movement) for a given object. In a preferred approach this event detector 73 is configured and arranged to conclude its event detection functionality in response to conclusion of the first window of time as measured by the first time window unit 72.

The specifics of the event detector 73 are likely to vary with the needs and requirements of a given application, and those skilled in the art will recognize and understand that these teachings are compatible for use with a wide variety of detectors. For example, the event detector 73 may comprise one or more of:

- an optical-based detector (such as an infrared-based detector, a laser-based detector, or even a vision-based detector, to name a few);
- a sound-based detector (such as an ultrasonic-based detector);
- a weight-based detector;
- a proximity-based detector (such as inductance loop detectors and other magnetic anomaly-based detectors);
- a radio frequency identifier-based detector (such as a radar-based detector, a radio frequency identification tag-based detector, and so forth). Such detectors and their manner of use are well understood in the art and require no further elaboration here.

This illustrative movable barrier operator 70 further preferably comprises a second time window unit 74 that is operably responsive to the first time window unit 72 and the event detector 73. This second time window unit 74 initiates a second window of time following completion of the first window of time as measured by the first time window unit 72 and/or in response to detection of a predetermined event of interest by the event detector 73.

A movable barrier closer 75 is responsive to the second time window unit 74 (and optionally, also, to the event detector 73) such that upon the second time window concluding and presumably subsequent to detection of the predetermined event of interest, the movable barrier closer 75 initiates movement of a corresponding movable barrier towards a closed position. (If desired, of course, other triggers 76 can be provided as well, such as a traditional button that can be used by a human operator to effect an immediate closure of the movable barrier. Inclusion of such additional triggers is not incompatible with these teachings.)

The above described movable barrier operator 70 again comprises only one of numerous platforms suitable to implement these teachings. Access control mechanisms often comprise partially or wholly programmable platforms and as such, are readily programmable to implement, support, and benefit from these teachings.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A method for use with an access control mechanism comprising:

detecting a predetermined event;

in response to detecting the predetermined event, determining whether a second predetermined event occurs by automatically determining whether an incident occurs during a first delay;

when the second predetermined event occurs:

automatically initiating a second delay, wherein the second delay is different than the first delay;

upon concluding the second delay, automatically causing the access control mechanism to initiate closure of a corresponding barrier;

when the second predetermined event does not occur, not automatically causing the access control mechanism to initiate closure of the corresponding barrier.

2. The method of claim 1 wherein automatically determining whether an incident occurs during a first delay further comprises: automatically initiating a monitoring period of at least a predetermined duration; automatically monitoring for the incident during the monitoring period.

3. The method of claim 2 and further comprising setting the predetermined duration as a function, at least in part, of a user-settable input.

4. The method of claim 2 wherein automatically initiating a monitoring period further comprises activating a timer.

5. The method of claim 2 wherein the incident further comprises detection of at least one predetermined event.

6. The method of claim 5 wherein the at least one predetermined event further comprises detection of movement of an object.

7. The method of claim 6 wherein the detection of movement of an object further comprises detection of a particular pattern of apparent object movement.

8. The method of claim 7 wherein the particular pattern of apparent object movement further comprises at least one of: a series of sensed events; at least one sensed event of at least a predetermined duration.

9. The method of claim 1 wherein automatically determining whether an incident occurs during a first delay further comprises automatically determining whether an incident is detected via at least one of: an optical-based detector; a sound-based detector; a weight-based detector; a proximity-based detector a radio frequency identifier-based detector.

10. The method of claim 9 wherein the optical-based detector comprises at least one of: an infrared-based detector; a laser-based detector; a vision-based detector.

11. The method of claim 1 wherein automatically determining whether an incident occurs during a first delay further comprises automatically determining whether a first delay concludes without detecting any of a plurality of incidents.

12. A method for use with an access control mechanism comprising:

detecting a predetermined event;

in response to detecting the predetermined event, determining whether a second predetermined event occurs by automatically determining whether either of at least a first incident and a second incident occurs;

when the second predetermined event occurs:

automatically initiating a delay;

upon concluding the delay, automatically causing the access control mechanism to initiate closure of a corresponding barrier;

when the second predetermined event does not occur, not automatically causing the access control mechanism to initiate closure of the corresponding barrier.

13. The method of claim 12 wherein not automatically causing the access control mechanism to initiate closure of the corresponding barrier further comprises, when the second predetermined event does occur and comprises the first incident, taking a first predetermined course of action.

14. The method of claim 13 wherein not automatically causing the access control mechanism to initiate closure of the corresponding barrier further comprises, when the second predetermined event does occur and comprises the second incident, taking a second predetermined course of action, which second predetermined course of action is different from the first predetermined course of action.

15. The method of claim 14 wherein the first incident corresponds to detection of movement of a vehicle.

16. The method of claim 15 wherein the second incident corresponds to detection of movement of a living object.

* * * * *